US006030524A

United States Patent [19]

Savage et al.

[11] Patent Number: 6,030,524

[45] **Date of Patent: *Feb. 29, 2000**

[54] REFINERY ATMOSPHERIC PIPESTILL WITH METHANOL STRIPPING

[75] Inventors: David W. Savage, Lebanon; Guido Sartori, Annandale, both of N.J.

[73] Assignee: Exxon Research and Engineering Co, Florham Park, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/167,153

[22] Filed: Oct. 6, 1998

[51] Int. Cl.[7] ..... B01D 3/34; B01D 3/38; B01D 3/04; C07C 7/00

[52] U.S. Cl. ..... 208/356; 208/362; 208/363; 585/864; 203/49; 203/66; 203/92; 203/96

[58] Field of Search ..... 208/356, 362, 208/363; 585/864; 203/92, 96, 66, 49

[56] References Cited

U.S. PATENT DOCUMENTS 4,319,980 3/1982 Jenkins ..... 208/8 LE
5,169,598 12/1992 Zetlmeisl, et al. ..... 422/16

FOREIGN PATENT DOCUMENTS

2024574C1 12/1994 Russian Federation .

*Primary Examiner*—Walter D. Griffin
*Assistant Examiner*—Tam M. Nguyen
*Attorney, Agent, or Firm*—Estelle C. Bakun

[57] ABSTRACT

In an atmospheric pipestill stripping process where steam is utilized as the stripping gas to strip bottoms and side stream products, the improvement comprising utilizing methanol or a methanol and steam mixture as said stripping gas. In a refinery atmospheric pipestill stripping process utilizing a stripping gas, said process comprising utilizing a gas selected from the group consisting of methanol and a mixture of methanol and steam as said stripping gas.

5 Claims, 1 Drawing Sheet

FIGURE
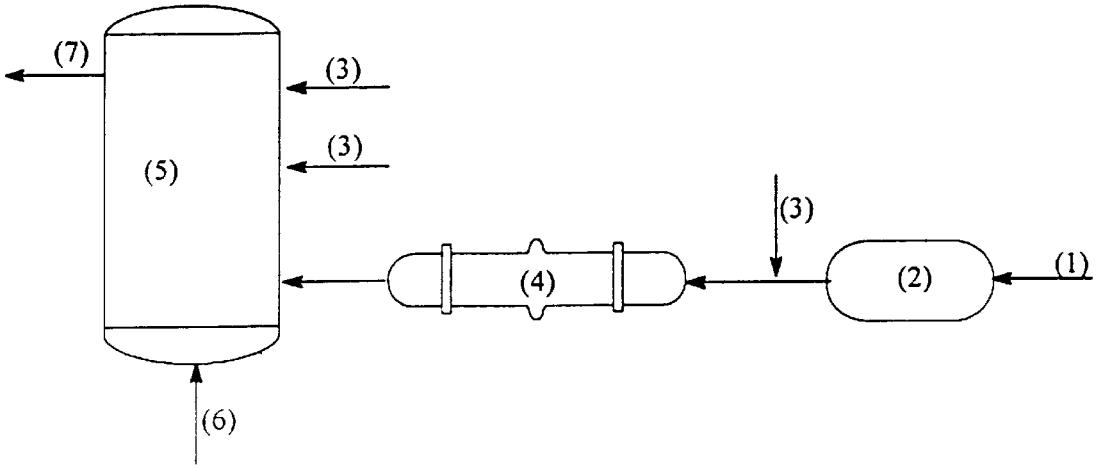

REFINERY ATMOSPHERIC PIPESTILL WITH METHANOL STRIPPING

FIELD OF THE INVENTION

This invention relates to reducing the corrosivity of corrosive crudes in a refinery pipestill while using decreased amounts of steam for atmospheric pipestill stripping.

BACKGROUND OF THE INVENTION

Crude oil refineries include an atmospheric pressure pipestill (APS) which fractionates the whole crude oil into various product fractions of different volatility, including gasoline, fuel oil gas oil and others. The lower boiling fractions, including naphtha, from which gasoline is derived, are recovered from the overhead fraction. The fractions with intermediate volatility are withdrawn from the tower as side streams. Side stream products include kerosene, jet fuel, diesel fuel, and gas oil. The higher up on the column the side stream is withdrawn, the more volatile the product. The heaviest components are withdrawn in the tower bottoms stream.

Stripping with steam is employed in atmospheric pipestills to strip bottoms and all side stream products (kerosene, diesel, gas oil). Without stripping, the typical pipestill, at best would be a poor fractionator. Steam stripping is used to adjust the front end of each liquid product to optimize the load to downstream processing, meet product specifications, or avoid downgrading a more valuable lighter product. Steam has historically been utilized as a stripping gas because it is available, inert and condensable and, thus, easily separated from hydrocarbons.

U.S. Pat. No. 5,169,598 discloses a corrosion inhibitor for refinery overhead streams. Example 1 includes methanol as a carrier for the corrosion inhibitor.

RU 2,024,574 teaches the use of an alcohol-ketone mixture as a distillation improver in atmospheric petroleum stills. 68 to 85 wt. % methanol is contained in the mixture; however, only 0.1 to 0.5 vol. % of the mixture is employed.

BRIEF DESCRIPTION OF THE FIGURE

The FIGURE shows a typical introduction of petroleum oil into a refinery. (1) is the petroleum oil, (2) the desalting unit, (3) and (6) methanol addition points, (4) a heat exchanger, (5) an atmospheric pipestill, and (7) methanol recovery.

SUMMARY OF THE INVENTION

In an atmospheric pipestill stripping process where steam is utilized as the stripping gas to strip bottoms and side stream products, the improvement comprising utilizing methanol or a methanol and steam mixture as said stripping gas.

In a refinery atmospheric pipestill stripping process utilizing a stripping gas, said process comprising utilizing a gas selected from the group consisting of methanol and a mixture of methanol and steam as said stripping gas.

DETAILED DESCRIPTION OF THE INVENTION

In the past, atmospheric pipestill stripping with steam has been utilized to strip bottoms and side stream products (e.g., kerosene, diesel, gas oil, etc.). Applicants have discovered that utilizing pure methanol in place of the steam as the stripping gas, or alternatively utilizing a methanol and steam mixture as the stripping gas, affords a much improved stripping process.

Applicants believe that stripping with methanol offers several advantages. The methanol can react with corrosive acids present in the crude oils being introduced into the pipestill, particularly naphthenic acids forming non-corrosive methyl esters of the naphthenic acids. This is most beneficial since corrosion in pipestills is a major concern for the refinery. Likewise, reduction of acidity will allow for processing of low-cost acidic crudes in existing equipment.

Additionally, use of methanol would back out an equivalent amount of steam thereby reducing the amount of sour water produced from the pipestill. Sour water is a refinery concern since it accounts for a significant portion of the load (approximately 55%) on the waste water treatment plant. In light of stricter environmental regulations, any lessening of waste loads is beneficial.

In the refinery, crude oil is passed to a desalter and heat exchanger prior to entering the atmospheric pipestill. In the instant invention, the methanol would be introduced into the crude just after the desalter. This allows for methanol reaction with naphthenic acids in the crude during heat exchange.

In the instant invention, methanol may be utilized as the sole stripping gas. Alternatively, a mixture of methanol and steam may be used as the stripping gas. In the case of a mixture, the ratio of methanol to steam will be about 0.1:1 to about 100:1, preferably about 1:1 to about 10:1. The methanol may be mixed with the petroleum oil following the desalting unit, if present, just prior to entering the heat exchanger. The heat of the heat exchanger will be sufficient to introduce the methanol as a gas or vapor into the atmospheric pipestill unit and to achieve esterification with the organic acids contained in the crude. Thus, the methanol and crude will be heated to a temperature of at least about 250° C., more preferably at least about 350° C. in the heat exchanger. In a typical refinery, petroleum oil is passed to a desalting unit and then a heat exchanger prior to entering the atmospheric pipestill. The methanol is preferably introduced after the desalting unit and before the heat exchanger or in the bottom of the atmospheric pipestill. The methanol may likewise be introduced along the pipestill. Two such ports are shown on the FIGURE. However, more or less ports along the pipestill can be employed.

Any excess methanol utilized in the stripping process may be recovered if desired. Recovery is easily accomplished by the skilled artisan.

In the instant invention, the refinery atmospheric pipestill is operated in the typical manner known to the skilled artisan. The only modification necessary to carry out the instant invention is that methanol or a methanol and steam mixture be utilized as the stripping gas in the atmospheric pipestill.

What is claimed is:

1. In an atmospheric pipestill stripping process where steam is utilized as the stripping gas to strip bottoms and side stream products, the improvement comprising utilizing as said stripping gas a stripping gas selected from the group consisting of methanol or a methanol and steam mixture.

2. A refinery atmospheric pipestill stripping process utilizing a stripping gas for stripping a crude oil, wherein said stripping gas is selected from the group consisting of methanol or a mixture of methanol and steam.

3. The process of claim 1 or 2 wherein when said stripping gas is a mixture of methanol and steam, the ratio of methanol to steam is about 0.1:1 to about 100:1.

4. The process of claim 1 or 2 wherein the stripping gas is heated to a temperature of at least about 250° C.

5. In a method for reducing the amount of sour water produced from an atmospheric pipestill stripping process utilizing steam as a stripping gas, the improvement comprising utilizing a gas selected from the group consisting of methanol and a mixture of methanol and steam as said stripping gas.

* * * * *